US006012940A

United States Patent [19]

Wheeler

[11] Patent Number: 6,012,940

[45] Date of Patent: Jan. 11, 2000

[54] EXTENSION CORD RETAINING DEVICE

[76] Inventor: Michael Wheeler, 40 Marwood Pl., Stony Brook, N.Y. 11790

[21] Appl. No.: 09/027,152

[22] Filed: Feb. 20, 1998

[51] Int. Cl.[7] ..... H01R 13/62

[52] U.S. Cl. ..... 439/369

[58] Field of Search ..... 439/367–369, 439/370–373

[56] References Cited

U.S. PATENT DOCUMENTS

| | | | |
|---|---|---|---|
| 2,461,427 | 2/1949 | Kneebone . | |
| 3,781,761 | 12/1973 | Harwood | 439/369 |
| 4,204,738 | 5/1980 | Tilloston . | |
| 4,769,876 | 9/1988 | Platt . | |
| 4,773,874 | 9/1988 | Kopeski . | |
| 4,925,399 | 5/1990 | Bosworth et al. . | |
| 5,104,355 | 4/1992 | Conley et al. . | |
| 5,179,044 | 1/1993 | Muromachi et al. . | |
| 5,336,106 | 8/1994 | Osten | 439/369 |
| 5,336,107 | 8/1994 | Sheryll . | |
| 5,423,693 | 6/1995 | Light | 439/369 |
| 5,593,312 | 1/1997 | McCracken | 439/369 |

*Primary Examiner*—Khiem Nguyen
*Attorney, Agent, or Firm*—Martin S. Glass, Esq.

[57] ABSTRACT

An apparatus is provided that is a semi-permanent cord retaining device having a single-piece, resilient, clip with at least two angled slots to receive the electrical power cord and the extension cord to be coupled. The two cords are twisted together and the clip is then inserted within the twist, sliding the cords into the slots. A gentle tug locks the clip in place and prevents the male and female electrical connectors of the cords from separating.

13 Claims, 2 Drawing Sheets

EXTENSION CORD RETAINING DEVICE

BACKGROUND OF THE INVENTION

1. Field of the Invention

This invention relates generally to an extension cord retaining device and more particularly to a retaining device that guards against accidental disconnection of connected electrical cords and the like, while being semi-permanently attached to the extension cord.

2. Description of the Related Art

In many industrial and commercial environments, it is often useful or even necessary to connect a number of electrical extension cords, or to connect an extension cord to an electrical appliance. In these environments, if the plug and socket combination inadvertently disengage during use, such disconnection can cause inconvenience, down time and a potential safety hazard.

Similarly, in the home environment, plugs of electrical power cords for equipment such as vacuum cleaners. electric powered lawn mowers, drills, lights and the like, must be coupled to receptacles of extension cords. The friction connections between coupling prongs of the plugs and the blades of the receptacles generally will not hold the cords together against anything more than moderate separation tugs.

In the past, in order to prevent the two cords from separating, carpenters and others have sometimes tied two cords together in a knot. This method is unsafe because it can weaken or break one or both of the cords at the cord ends, creating an electrical hazard. Tape has also been used to hold cords together. Although this can work, it is often messy, leaving a residue of adhesive on the connectors after the tape has been removed.

A number of clips or clamps for holding electrical cord connectors together have been suggested and developed to retain two electrical cords and plugs. By way of example, U.S. Pat. No. 5,336,107 by Richard Sheryll or U.S. Pat. No. 5,179,044 by Paul N. Muromachi et al. These, and like devices, typically are often time consuming to attach and require more than one part. This makes them complicated to manufacture and difficult to use. Also, many of these devices require permanent attachment to the plugs and receptacles, forcing the user to purchase multiple sets, or be attached to the cords during the manufacturing stage of the cord itself. Others must be detached from the cords if not in use and therefore need to be moved from connection to connection.

A need therefore exists for a cord retaining device that can be permanent or semi-permanent to an extension cord and overcome the shortcomings of the known devices.

SUMMARY OF THE INVENTION

In accordance with the principles of the invention, a semi-permanent cord retaining device is achieved by having a single-piece, resilient, cord clip having at least two angled slots to receive the electrical power cord and the extension cord to be coupled.

According to one aspect of the present invention, an extension cord retaining device is achieved by crossing the cords of the two electrical power cord and the extension cord, and then placing them into the aforementioned angled slots. This then will have the effect of holding the male and female portions of the connectors together as the two cords are pulled and tugged during use.

DESCRIPTION OF THE DRAWINGS

So that one skilled in the art to which the subject invention appertains will better understand how to practice the present invention, preferred embodiments of the apparatus and method will be described in detail hereinbelow with reference to the drawings wherein.

DETAILED DESCRIPTION OF PREFERRED EMBODIMENTS

Figure 1:
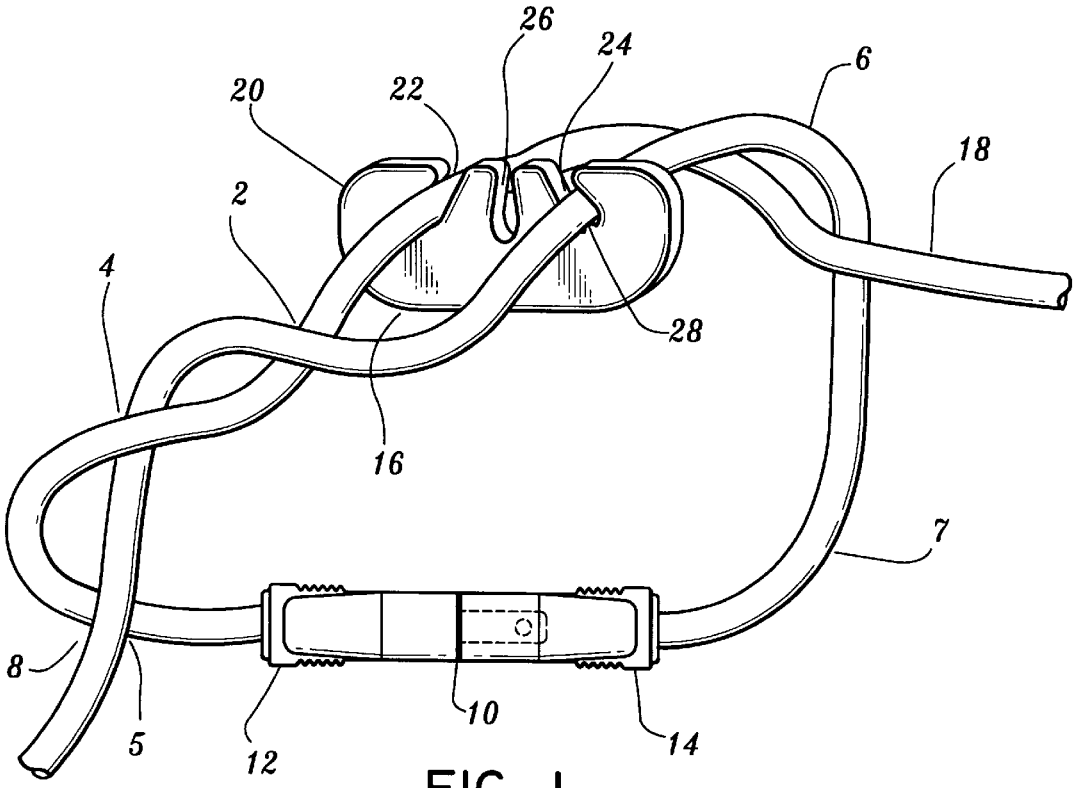
FIG. 1 is an isometric view of an extension cord retaining device in accordance with the principles of the present invention using angular slots.

FIG. 1 shows a first embodiment as an isometric view of an extension cord retaining device 20 in accordance with the principles of the present invention. The retaining device 20 is made out of, for example, high-density polyethylene plastic, metal encased in plastic, such as steel or aluminum, hardened rubber or any other non-electrically conductive material. The male end 12 of either an extension cord or an electrical power cord 5 is looped around and inserted into the female end 14 of an extension cord 7 at junction 10. This forms a single twist 4 with the two cords 5 and 7. The extension cord 7 is then looped over the power cord 5 at points 2 and 6. This creates a central receiving area 16 in which the retaining device 20 is placed. The cord from the power cord 5 is slid into the angled slot 22 of the extension cord retaining device 20. The cord from the extension cord 7 is slid into the oppositely angled slot 24 of the retaining device 20. These slots 22 and 24 are angled away from each other such that the distance between the two slots increases as the two cords are downwardly inserted. The extension cord 7 at point 8 and the power cord 5 at point 18 are then gently pulled, locking the retaining device 20 in place. The male end 12 and the female end 14 of the respective cords are now prevented from pulling apart.

An additional feature can be added to the retaining device 20 for typical indoor uses. A third slot 26 is placed in the center of the device 20. This is used for smaller, flat wires and cords, such as those from indoor extension cords or electrical appliances. In this embodiment, one cord is placed in slot 22, and the indoor extension cord is placed in the center slot 26, instead of the angled slot 24.

As an enhancement to the retaining device 20, nubs 28 are placed on the bottom of the angled slots 22 and 24. This will cause to strengthen the retaining power of the cords in the slots. Additional nubs can be placed on the sides of the slots.

Figure 2:
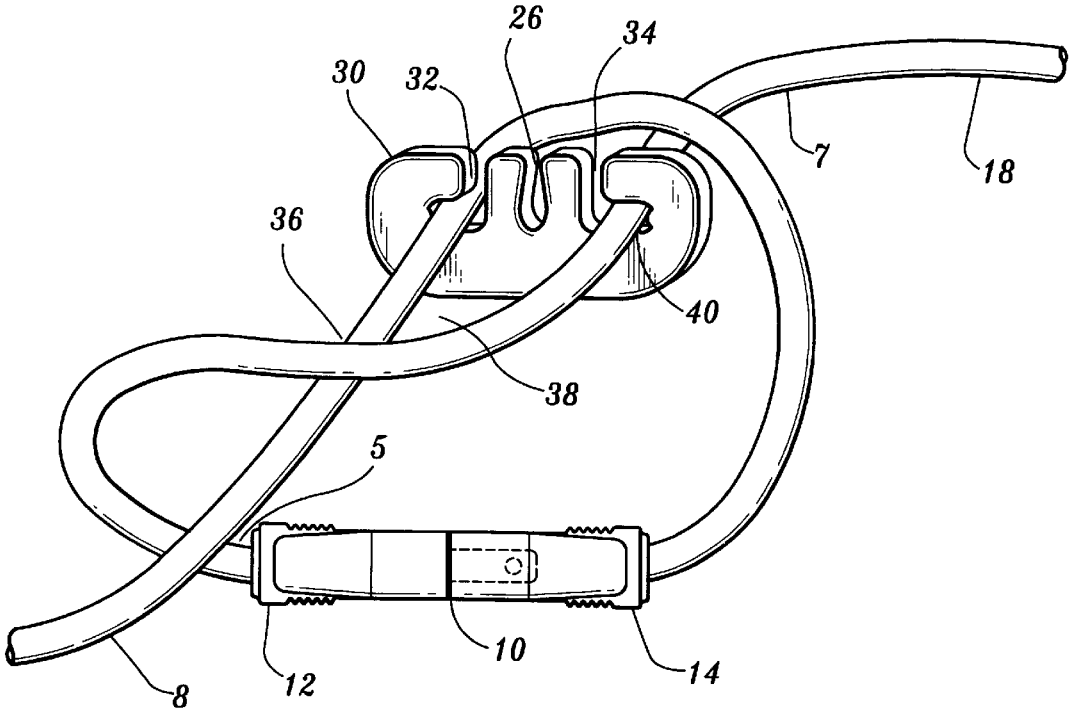
FIG. 2 is an isometric view of an extension cord retaining device in accordance with the principles of the present invention using L-shaped slots.

FIG. 2 shows a second embodiment of an extension cord retaining device 30 in accordance with the principles of the present invention. This embodiment has two L-shaped slots 32 and 34.

In this particular embodiment, FIG. 2 shows an alternate method of connecting the extension cord 7 and the power cord 5 to the retaining device 30 is used. The male end 12 of either the extension cord or the electrical power cord 5 is looped around the female end 14 of the extension cord 7, forming a loose knot. This forms a single twist 36 with the two cords 5 and 7. The knot creates a central receiving area 38 in which the retaining device 30 is placed. The cord from the power cord 5 is slid into the L-slot 34 of the retaining device 20. The cord from the extension cord 7 is slid into the opposite L-slot 32 of the retaining device 20. These L-slots arc such that the lower portions point away from each other and move the two cords away from each other as they are inserted. The extension cord 7 at point 8 and the power cord 5 at point 18 are then gently pulled, locking the retaining device 20 in place. The method of attachment shown and described in FIG. 1 can also be used with the L-slot extension cord retaining device 30, as shown in FIG. 2. The method of attachment shown and described in FIG. 2 can, conversely, be used with the extension cord retaining device 20, as shown in FIG. 1.

FIG. 2 also shows an enhancement to the retaining device 30. Nubs 40 are placed on the bottom of the L-slots 32 and 34. This will cause to strengthen the retaining power of the cords in the slots. Additional nubs can be placed on the sides of the slots.

Figure 3:
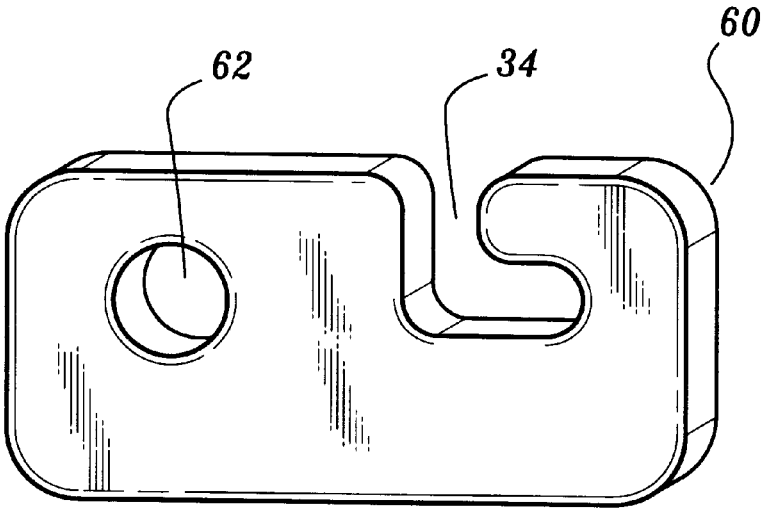
FIG. 3 is a front view of a permanent extension cord retaining device in accordance with the principles of the present invention.

FIG. 3 is an alternate embodiment of the present invention, showing the front view of a permanent extension cord retaining device 60. The cord of the extension cord (not shown) is inserted directly onto device 60 through slot 62 prior to the manufacturer of the cord attaching the male or female end of the cord. A user can also, for example, cut off one end of the extension cord, insert the retaining device 60 onto the cord and then attach, for example, a replacement male or female end. The user need then only to attach the power equipment cord to the device 60 at slot 34. Slot 34 may be either the L-slot as shown in FIG. 3, or the angled slot as shown in FIG. 1 at 24.

Figure 4:
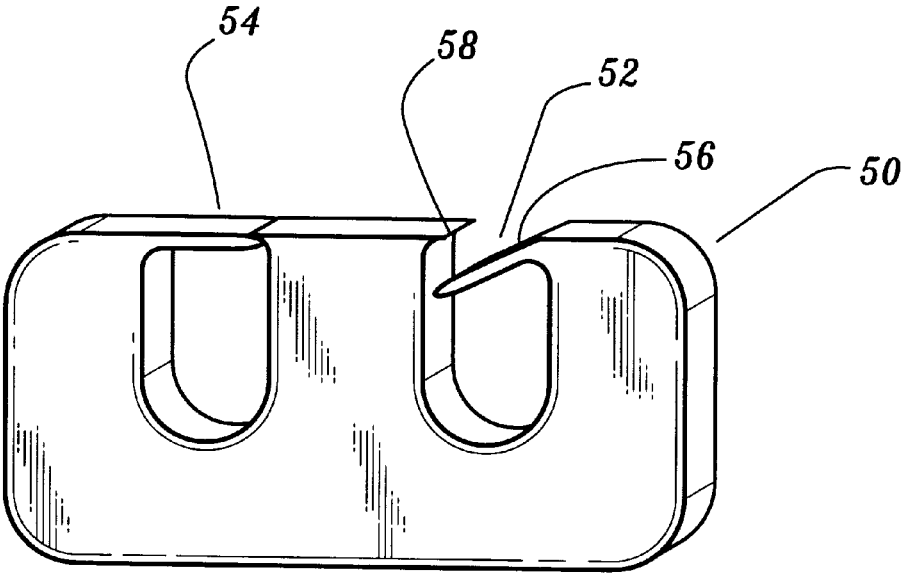
FIG. 4 is a front view of a semi-permanent extension cord retaining device in accordance with the principles of the present invention.

FIG. 4 is a further alternate embodiment of the present invention showing the front view of a semi-permanent extension cord retaining device 50. The cords of the extension cord and of the power equipment cord (not shown) arc twisted in either a similar manner as shown and described in FIG. 1, or as shown and described in FIG. 2. While sliding the cord into slot 52, retaining door 56 is pushed into the interior portion of slot 52. Once the cord has moved into the lower portion of slot 52, the retaining door 56 springs back into a horizontal position up against retaining lip 58. This effectively locks the cord into slot 53. In order for the cord to be removed, a user simply needs to bend retaining door 56 into the interior portion of slot 52 and then slid the cord out of the slot. Slots 52 and 54 may be either a straight vertical slot as shown in FIG. 4, an L-slot as shown in FIG. 3, or an angled slot as shown in FIG. 1.

Although the subject invention has been described with respect to preferred embodiments, it will be readily apparent to those having ordinary skill in the art to which it appertains that changes and modifications may be made thereto without departing from the spirit or scope of the subject invention as defined by the appended claims.

What is claimed is:

1. An electrical cord retainer for retaining male and female couplers of electrical power cords together, comprising:

a first end of retainer, wherein top portion of said first end includes a first slot having at least one nub within said first slot, allowing a first electrical power cord to slide and lock into said first slot; and a second end of retainer adjacent said first end, wherein top portion of said second end includes a second slot having at least one nub within said second slot allowing a second electrical power cord to slide and lock into said second slot.

2. The electrical cord retainer of claim 1, wherein said first slot and said second slot are angled diagonally away from each other moving from top to bottom of said retainer.

3. The electrical cord retainer of claim 1, wherein said first slot and said second slot are essentially L-shaped, angled away from each other moving from top to bottom of said retainer.

4. The electrical cord retainer of claim 1, further comprising vertical slot between said first slot and said second slot.

5. The electrical cord retainer of claim 1, wherein top portion of said first end includes a retaining door over said first slot preventing said first cord from slipping out of said first slot, and wherein top portion of said second end includes a retaining door over said second slot preventing said second cord from slipping out of said second slot.

6. The electrical cord retainer of claim 3, wherein top portion of said first end includes a retaining door over said first slot preventing said first cord from slipping out of said first slot, and wherein top portion of said second end includes a retaining door over said second slot preventing said second cord from slipping out of said second slot.

7. The electrical cord retainer of claim 1, wherein said retainer is fabricated out of a non-electrically conducting material.

8. The electrical cord retainer of claim 1, wherein said first slot is replaced with a fully enclosed opening, permanently securing said first electrical power cord to retainer.

9. An electrical cord retainer for retaining male and female couplers of electrical power cords together, comprising:

a first end of retainer, wherein top portion of said first end includes a first slot with at least one nub allowing a first electrical power cord to slide and lock into said first slot; and a second end of retainer adjacent said first end, wherein top portion of said second end includes a second slot with at least one nub allowing a second electrical power cord to slide and lock into said second slot, and wherein said first slot and said second slot are angled diagonally away from each other moving from top to bottom of said retainer.

10. The electrical cord retainer of claim 9, wherein top portion of said first end includes a retaining door over said first slot preventing said first cord from slipping out of said first slot, and wherein top portion of said second end includes a retaining door over said second slot preventing said second cord from slipping out of said second slot.

11. The electrical cord retainer of claim 9, wherein said retainer is fabricated out of a non-electrically conducting material.

12. The electrical cord retainer of claim 9, wherein said frist slot is replaced with a fully enclosed opening, permanently securing said first electrical power cord to retainer.

13. The electrical cord reatiner of claim 9, further comprising vertical slot between said first slot and said second slot.

* * * * *